US006615694B1

(12) United States Patent
Macor

(10) Patent No.: US 6,615,694 B1
(45) **Date of Patent: *Sep. 9, 2003**

(54) ACCESSIBLE ADJUSTABLE TYPE WRENCH

(75) Inventor: Richard J. Macor, Hunterdon County, NJ (US)

(73) Assignee: Proprietary Technologies, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 10/301,071

(22) Filed: Nov. 21, 2002

Related U.S. Application Data

(63) Continuation-in-part of application No. 10/141,212, filed on May 8, 2002, now Pat. No. 6,484,610.

(51) Int. Cl.[7] ..... B25B 13/16

(52) U.S. Cl. ..... 81/165; 81/186; 81/490

(58) Field of Search ..... 81/165, 186, 490, 81/166, 167; D8/22

(56) References Cited

U.S. PATENT DOCUMENTS 6,484,610 B1 * 11/2002 Macor ..... 81/165

* cited by examiner

*Primary Examiner*—Lee D. Wilson

(57) ABSTRACT

An adjustable, open end wrench is described having a wrench head for turning a variety of different size fasteners. The wrench head comprises two jaws each having an engaging surface for engaging with the fasteners. One jaw is generally fixed and connected to a gripping portion formed as a wrench lever and the other jaw is movable relative to the fixed jaw. The wrench head comprises an adjustable mechanism by which the jaws may be spaced apart including a defined maximum spacing dimension between the jaws. The wrench head further comprises an imaginary centerline intersecting both of the jaws through a midpoint of a length of the jaws substantially perpendicular to the engaging surfaces of the jaws as viewed from a side view thereof And further wherein, each jaw has a width dimension measured at the centerline, and the width dimension of both jaws combined is also defined.

16 Claims, 2 Drawing Sheets

ACCESSIBLE ADJUSTABLE TYPE WRENCH

REFERENCES TO RELATED APPLICATIONS

This application relates to and is a Continuation-In-Part of U.S. patent application Ser. No. 10/141,212 entitled ACCESSIBLE ADJUSTABLE WRENCH filed on May 8, 2002, now U.S. Pat. No. 6,484,610. Other related U.S. Patents granted to the inventor herein include U.S. Pat. No. Des. 414,996 entitled ADJUSTABLE WRENCH HEAD WITH BEAK TIP filed on Oct. 13, 1998; and, U.S. Pat. No. Des. 434,956 entitled ADJUSTABLE OPEN END WRENCH HEAD filed on Mar. 1, 1999.

FIELD OF THE INVENTION

The present invention relates to hand tools, particularly wrenches and most particularly adjustable, open end type wrenches.

BACKGROUND OF THE INVENTION

Adjustable, open end type wrenches have existed for many years. The American Society of Mechanical Engineers (ASME) has developed standards for this common wrench. The advantages of an adjustable wrench are obvious, and include adjustable spacing between the jaws so that the one tool may interact with and turn a variety of different size fasteners. The disadvantages of an adjustable wrench are not immediately obvious. A major disadvantage of the typical, prior art adjustable wrench is its relatively wide structured head and jaws. The wide wrench head and wide jaws prohibit engagement and access with fasteners in limited access environments. Accordingly, there is a need to develop a better adjustable, open end wrench, structured differently than the prior art adjustable wrenches, to improve engagement and access with fasteners located in limited access environments.

SUMMARY OF THE INVENTION

An adjustable, open end wrench is described having a wrench head for turning a variety of different size fasteners. The wrench head comprises two jaws each having an engaging surface for engaging with the fasteners. One jaw is generally fixed and connected to a gripping portion formed as a wrench lever and the other jaw is movable relative to the fixed jaw. The wrench head comprises an adjustable means by which the jaws may be spaced apart including a defined maximum spacing dimension between both jaws. The wrench head further comprises an imaginary centerline intersecting both of the jaws through a midpoint of a length of the jaws and substantially perpendicular to the engaging surfaces of the jaws as viewed from a side view thereof. And further wherein, each jaw has a width dimension measured at the centerline, and the width dimension of both jaws combined is also defined.

As described earlier herein, a major disadvantage of the prior art adjustable wrench is its relatively wide structured head and jaws. The wide wrench head and wide jaws prohibit engagement and access with fasteners located in limited access environments. Accordingly, there is a need to develop a better adjustable wrench which is structured differently than the prior art adjustable wrenches, to improve engagement and access with fasteners located in limited access environments.

Accordingly, it is an important objective of the present invention described above to achieve an improved adjustable wrench which can engage with and access fasteners located in limited access environments.

It is another objective of the present invention that it be durable and strong enough to exceed the standards developed by the American Society of Mechanical Engineers (ASME).

It is another objective of the present invention that it be commercially viable, simple in design, and cost efficient to manufacture.

DETAILED DESCRIPTION OF THE DRAWINGS

Figure 1:
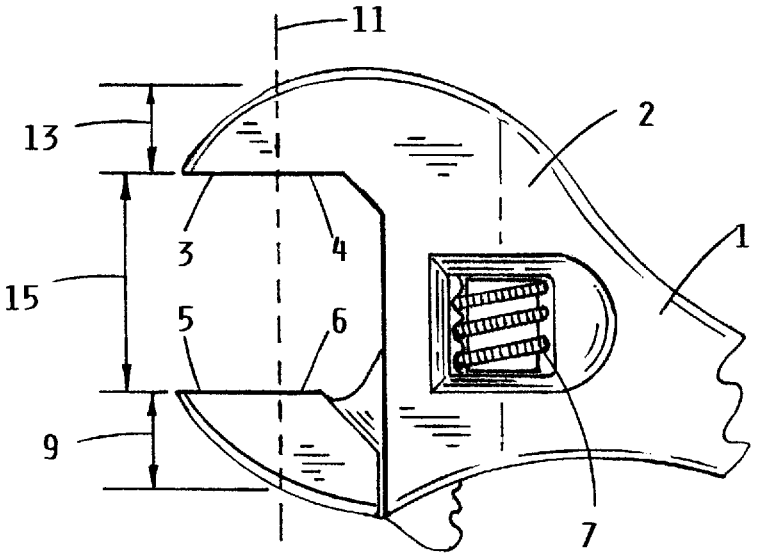
FIG. 1 PRIOR ART
FIG. 1 shows a left side, sectional view of a Prior Art adjustable wrench with details of the adjustable wrench head; and, FIG. 2 shows a left side, sectional view of a present invention adjustable wrench with details of the adjustable wrench head; and, FIG. 3 shows a left side, view of a present invention adjustable wrench in its entirety.

Referring now to the drawings which are for the purpose of illustrating preferred embodiments of the present invention and not for the purpose of limiting same, FIG. 1 shows a left side, sectional view of a Prior Art adjustable wrench with details of the adjustable wrench head. Adjustable wrench 1 has a wrench head 2 comprising a fixed jaw 3 and a movable jaw 5. Wrench head 2 is typical of a prior art adjustable wrench head in both shape and structure. Jaw 3 has engaging surface 4, and jaw 5 has engaging surface 6, both engaging surfaces are formed for engagement with various fasteners, nuts bolts etc. Wrench head 2 includes an imaginary centerline 11 which is about centered relative to the length of jaws 3 and 5, and substantially perpendicular to engaging surfaces 4 and 6 as shown. Adjustable means 7 is used to space jaws 3 and 5 at different dimensions to engage with and turn various fasteners having various different dimensions. The maximum spacing dimension between the jaws is shown here by dimension 15, which is the maximum amount jaws 3 and 5 may be spaced apart using adjustable means 7. This maximum spacing dimension relates to other dimensions of the wrench head including the jaw width dimension 13 of jaw 3, and the jaw width dimension 9 of jaw 5. Both jaw width dimensions are measured at imaginary centerline 11 and substantially perpendicular to the jaw engaging surfaces 4 and 6 as shown. Many factors have contributed to the jaw width dimensions of the typical, prior art wrench shown, including strength and durability specifications developed by the American Society of Mechanical Engineers (ASME). Whereas, the jaw width dimension 13 of jaw 3, combined with the jaw width dimension 9 of jaw 5, is about equal to the maximum spacing dimension 15 as shown. In other words, if the maximum spacing dimension 15 of wrench head 2 was about 1.125 inches, the jaw width dimensions 13 and 9 (combined together) would also be equal to about 1.125 inches, or 100% of the maximum spacing dimension as defined herein. This dimensional relationship may vary slightly but is very typical of prior art adjustable, open end wrenches. The advantages of an adjustable wrench are obvious which include adjustable spacing between the jaws so that the one tool may interact and turn a variety of different size fasteners. The disadvantages of an adjustable wrench are not immediately obvious. A major disadvantage of the typical, prior art adjustable wrench is its relatively wide structured head and jaws. The wide wrench head and wide jaws prohibit interaction and access with fasteners in limited access environments. Accordingly, there is a need to develop a better adjustable, open end wrench which is formed differently than the prior art adjustable wrenches, to improve engagement and access with fasteners located in limited access environments.

Figure 2:
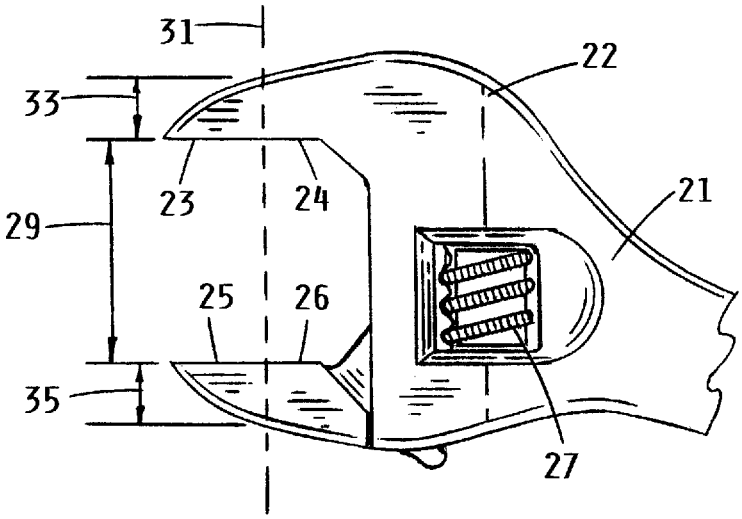

FIG. 2 shows a left side, sectional view of a present invention adjustable wrench with details of the adjustable wrench head. In this view, adjustable wrench 21 is shown having wrench head 22 for turning a variety of different size fasteners. Wrench head 22 comprises two jaws 23 and 25 each having an engaging surface for engaging with the fasteners. Jaw 23 has engaging surface 24, and, jaw 25 has engaging surface 26. These engaging surfaces may be planar and/or roughened to enhance the coefficient of friction between the engaging surface and fastener being turned. Jaw 23 is generally fixed and connected to a gripping portion formed as a wrench lever (not shown in this sectional view) and the other jaw 25 is movable relative to fixed jaw 23. Wrench head 22 also comprises an adjustable means 27 by which jaws 23 and 25 may be spaced apart including a maximum spacing dimension 29 between the jaws. Wrench head 22 further comprises an imaginary centerline 31 which is about centered relative to the length of jaws 23 and 25, and substantially perpendicular to engaging surfaces 24 and 26 as shown in this side view. Maximum spacing dimension 29 is the maximum amount jaws 23 and 25 may be spaced apart using adjustable means 27. When considering the present invention, the maximum spacing dimension is defined and may be equal to or slightly greater than 0.938 inch. In another embodiment, the maximum spacing dimension may be equal to or slightly greater than 1.125 inches. In another embodiment, the maximum spacing dimension may be equal to or slightly greater than 1.290 inches. And, in yet another embodiment, the maximum spacing dimension could be equal to or slightly greater than 1.5 inches. This maximum spacing dimension 29 relates to other dimensions of the wrench head including jaw width dimension 33 and jaw width dimension 35. The jaw width dimension of each jaw is measured at the centerline 31, and the width dimension of both jaws combined (33+35) is relative to the maximum spacing dimension 29 between the jaws. When the maximum spacing dimension of a present invention wrench is equal to or slightly greater than 0.938 inch, the width dimension of both jaws combined (33+35) is generally equal to or greater than 0.469 inch; and, generally equal to or less than 0.704 inch. When the maximum spacing dimension of a present invention wrench is equal to or slightly greater than 1.125 inches, the width dimension of both jaws combined (33+35) is generally equal to or greater than 0.562 inch; and, generally equal to or less than 0.844 inch. When the maximum spacing dimension of a present invention wrench is equal to or slightly greater than 1.290 inches, the width dimension of both jaws combined (33+35) is generally equal to or greater than 0.645 inch; and, generally equal to or less than 0.968 inch. And, when the maximum spacing dimension of a present invention wrench is equal to or slightly greater than 1.5 inches, the width dimension of both jaws combined (33+35) is generally equal to or greater than 0.750 inch; and, generally equal to or less than 1.125 inches. Accordingly, the width dimension of both jaws combined (33+35) is generally equal to or greater than 50% of the defined maximum spacing dimension 29 between the jaws; and, the width dimension of both jaws combined (33+35) is generally equal to or less than 75% of the maximum spacing dimension between the jaws. Such a structural arrangement provides superior engagement and access with fasteners located in limited access environments.

Figure 3:
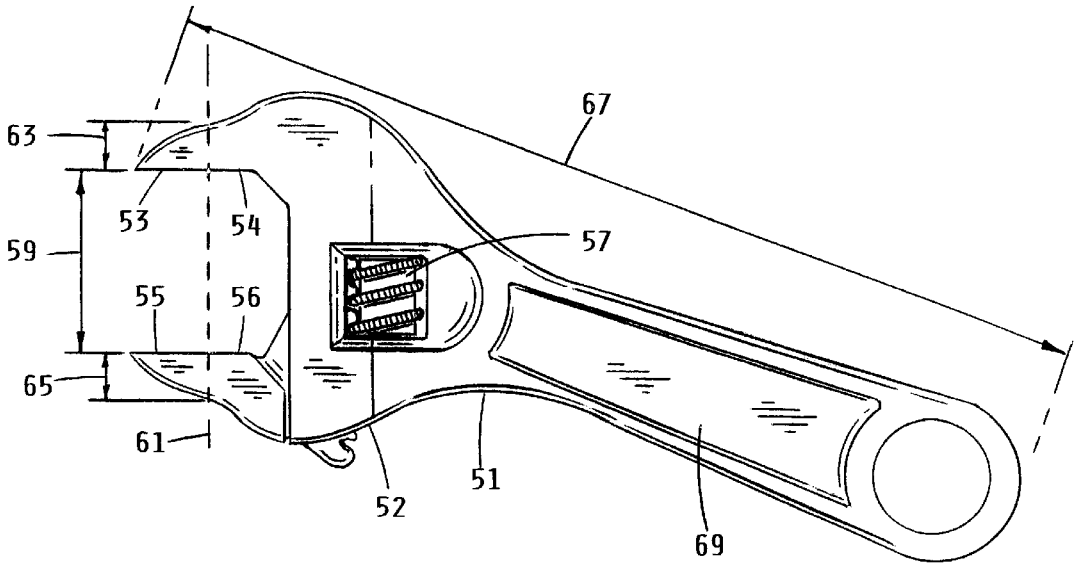

FIG. 3 shows a left side view of a present invention adjustable wrench in its entirety. In this view, adjustable wrench 51 is shown having wrench head 52 for turning a variety of different size fasteners. Wrench head 52 comprises two jaws 53 and 55 each having an engaging surface for engaging with the fasteners. Jaw 53 has engaging surface 54, and, jaw 55 has engaging surface 56. These engaging surfaces may be planar and/or roughened to enhance the coefficient of friction between the engaging surface and fastener being turned. Jaw 53 is generally fixed and connected to gripping portion 69 formed as a wrench lever, and jaw 55 is movable relative to fixed jaw 53. Wrench head 52 also comprises an adjustable means 57 by which jaws 53 and 55 may be spaced apart including a maximum spacing dimension 59 between the jaws. Wrench head 52 further comprises an imaginary centerline 61 which is about centered relative to the length of jaws 53 and 55, and substantially perpendicular to engaging surfaces 54 and 56 as shown in this side view. Maximum spacing dimension 59 is the maximum amount jaws 53 and 55 may be spaced apart using adjustable means 57. This maximum spacing dimension relates to other dimensions of the wrench head including jaw width dimension 63 and jaw width dimension 65. The jaw width dimension of each jaw is measured at the centerline 61, and the width dimension of both jaws combined (63+65) is relative to the maximum spacing dimension 59 between the jaws. When the maximum spacing dimension of a present invention wrench is equal to or slightly greater than 0.938 inch, the width dimension of both jaws combined (63+65) is generally equal to or greater than 0.469 inch; and, generally equal to or less than 0.704 inch. When the maximum spacing dimension of a present invention wrench is equal to or slightly greater than 1.125 inches, the width dimension of both jaws combined (63+65) is generally equal to or greater than 0.562 inch; and, generally equal to or less than 0.844 inch. When the maximum spacing dimension of a present invention wrench is equal to or slightly greater than 1.290 inches, the width dimension of both jaws combined (63+65) is generally equal to or greater than 0.645 inch; and, generally equal to or less than 0.968 inch. And, when the maximum spacing dimension of a present invention wrench is equal to or slightly greater than 1.5 inches, the width dimension of both jaws combined (63+65) is generally equal to or greater than 0.750 inch; and, generally equal to or less than 1.125 inches. Accordingly, the width dimension of both jaws combined (63+65) is generally equal to or greater than 50% of the defined maximum spacing dimension 59 between the jaws. And, the width dimension of both jaws combined (63+65) is generally equal to or less than 75% of the defined maximum spacing dimension 59 between the jaws. Such a structural arrangement provides superior engagement and access with fasteners located in limited access environments.

Another novel feature of adjustable wrench 51 is the relationship of its overall length 67 to the maximum spacing dimension 59. Here the total length 67 of wrench 51 may also be defined relative to the other structual features of the wrench. When a present invention wrench has a maximum spacing dimension 59 which is generally equal to or slightly greater than 0.938 inch, the overall length of the wrench is preferably equal to or less than 4.5 inches. When a present invention wrench has a maximum spacing dimension 59 which is generally equal to or slightly greater than 1.125 inches, the overall length of the wrench is preferably equal to or less than 6.5 inches. When a present invention wrench has a maximum spacing dimension 59 which is generally equal to or slightly greater than 1.290 inches, the overall length of the wrench is preferably equal to or less than 8.5 inches. And, when a present invention wrench has a maximum spacing dimension 59 which is generally equal to or slightly greater than 1.5 inches, the overall length of the wrench is preferably equal to or less than 10.5 inches.

Upon reading and understanding the specification of the present invention described above, modifications and alterations will become apparent to those skilled in the art. It is intended that all such modifications and alterations be included insofar as they come within the scope of the patent as claimed or the equivalence thereof.

What is claimed is:

1. An adjustable, open end wrench having a wrench head for turning a variety of different size fasteners, said wrench head comprising two jaws each having an engaging surface for engaging with said fasteners; one said jaw being generally fixed and connected to a gripping portion formed as a wrench lever and the other said jaw being movable relative to said fixed jaw, said wrench head comprising an adjustable means by which said jaws may be spaced apart including a maximum spacing dimension between said jaws being substantially equal to or slightly greater than 0.938 inch, said wrench head further comprising an imaginary centerline intersecting both of said jaws and passing through a midpoint of a length of said jaws substantially perpendicular to the engaging surfaces of said jaws as viewed from a side view thereof, and further wherein, each said jaw has a width dimension measured at said centerline, and the width dimension of both jaws combined is substantially equal to or greater than 0.469 inch and substantially equal to or less than 0.704 inch.

2. The wrench head of claim 1, wherein the maximum spacing dimension between said jaws is about 0.938 inch.

3. The wrench head of claim 2, wherein said wrench has an overall length being substantially equal to or less than 4.5 inches.

4. The wrench head of claim 1, wherein said wrench has an overall length being substantially equal to or less than 4.5 inches.

5. An adjustable, open end wrench having a wrench head for turning a variety of different size fasteners, said wrench head comprising two jaws each having an engaging surface for engaging with said fasteners; one said jaw being generally fixed and connected to a gripping portion formed as a wrench lever and the other said jaw being movable relative to said fixed jaw, said wrench head comprising an adjustable means by which said jaws may be spaced apart including a maximum spacing dimension between said jaws being substantially equal to or slightly greater than 1.125 inches, said wrench head further comprising an imaginary centerline intersecting both of said jaws and passing through a midpoint of a length of said jaws substantially perpendicular to the engaging surfaces of said jaws as viewed from a side view thereof, and further wherein, each said jaw has a width dimension measured at said centerline, and the width dimension of both jaws combined is substantially equal to or greater than 0.562 inch and substantially equal to or less than 0.844 inch.

6. The wrench head of claim 5, wherein the maximum spacing dimension between said jaws is about 1.125 inches.

7. The wrench head of claim 5, wherein said wrench has an overall length being substantially equal to or less than 6.5 inches.

8. The wrench head of claim 6, wherein said wrench has an overall length being substantially equal to or less than 6.5 inches.

9. An adjustable, open end wrench having a wrench head for turning a variety of different size fasteners, said wrench head comprising two jaws each having an engaging surface for engaging with said fasteners; one said jaw being generally fixed and connected to a gripping portion formed as a wrench lever and the other said jaw being movable relative to said fixed jaw, said wrench head comprising an adjustable means by which said jaws may be spaced apart including a maximum spacing dimension between said jaws being substantially equal to or slightly greater than 1.290 inches, said wrench head further comprising an imaginary centerline intersecting both of said jaws and passing through a midpoint of a length of said jaws substantially perpendicular to the engaging surfaces of said jaws as viewed from a side view thereof, and further wherein, each said jaw has a width dimension measured at said centerline, and the width dimension of both jaws combined is substantially equal to or greater than 0.645 inch and substantially equal to or less than 0.968 inch.

10. The wrench head of claim 9, wherein the maximum spacing dimension between said jaws is about 1.290 inches.

11. The wrench head of claim 10, wherein said wrench has an overall length being substantially equal to or less than 8.5 inches.

12. The wrench head of claim 9, wherein said wrench has an overall length being substantially equal to or less than 8.5 inches.

13. An adjustable, open end wrench having a wrench head for turning a variety of different size fasteners, said wrench head comprising two jaws each having an engaging surface for engaging with said fasteners; one said jaw being generally fixed and connected to a gripping portion formed as a wrench lever and the other said jaw being movable relative to said fixed jaw, said wrench head comprising an adjustable means by which said jaws may be spaced apart including a maximum spacing dimension between said jaws being substantially equal to or slightly greater than 1.5 inches, said wrench head further comprising an imaginary centerline intersecting both of said jaws and passing through a midpoint of a length of said jaws substantially perpendicular to the engaging surfaces of said jaws as viewed from a side view thereof, and further wherein, each said jaw has a width dimension measured at said centerline, and the width dimension of both jaws combined is substantially equal to or greater than 0.750 inch and substantially equal to or less than 1.125 inches.

14. The wrench head of claim 13, wherein the maximum spacing dimension between said jaws is about 1.5 inches.

15. The wrench head of claim 14, wherein said wrench has an overall length being substantially equal to or less than 10.5 inches.

16. The wrench head of claim 13, wherein said wrench has an overall length being substantially equal to or less than 10.5 inches.

* * * * *